US005768660A

United States Patent [19]

Kurihara et al.

[11] Patent Number: 5,768,660

[45] Date of Patent: Jun. 16, 1998

[54] CHARGING DEVICE AND PROCESS CARTRIDGE

[75] Inventors: Satoshi Kurihara, Toride; Kazuyoshi Odagawa, Koshigaya; Kazumi Sekine, Shizuoka-ken; Shinichi Sasaki, Fujisawa; Isao Ikemoto, Kashiwa; Toshiyuki Karakama, Tokyo; Takao Nakagawa, Numazu, all of Japan

[73] Assignee: Canon Kabushiki Kaisha, Tokyo, Japan

[21] Appl. No.: 688,926

[22] Filed: Jul. 31, 1996

[30] Foreign Application Priority Data

Aug. 2, 1995 [JP] Japan ..... 7-197546
Jan. 30, 1996 [JP] Japan ..... 8-035475

[51] Int. Cl.[6] ..... G03G 15/02; G03G 15/00

[52] U.S. Cl. ..... 399/111; 361/221; 361/225; 399/115; 399/176

[58] Field of Search ..... 399/90, 111, 115, 399/174, 176, 121, 116, 117; 361/214, 221, 225; 439/13, 18, 28, 29

[56] References Cited

U.S. PATENT DOCUMENTS

| | | | |
|---|---|---|---|
| 5,144,368 | 9/1992 | Ohzeki et al. | 399/176 |
| 5,331,372 | 7/1994 | Tsuda et al. | 399/114 |
| 5,345,294 | 9/1994 | Nomura et al. | 399/90 |
| 5,404,198 | 4/1995 | Noda et al. | 399/107 |
| 5,450,166 | 9/1995 | Yashiro | 399/111 |
| 5,470,635 | 11/1995 | Shirai et al. | 428/131 |
| 5,475,470 | 12/1995 | Sasago et al. | 399/111 |
| 5,488,459 | 1/1996 | Tsuda et al. | 399/167 |
| 5,500,714 | 3/1996 | Yashiro et al. | 399/111 |
| 5,510,878 | 4/1996 | Noda et al. | 399/111 |
| 5,534,344 | 7/1996 | Kisu et al. | 361/221 X |
| 5,537,187 | 7/1996 | Sekine | 399/113 |
| 5,543,898 | 8/1996 | Shishido et al. | 399/111 |
| 5,581,325 | 12/1996 | Tsuda et al. | 399/116 |
| 5,585,896 | 12/1996 | Yamazaki et al. | 399/174 |
| 5,697,020 | 12/1997 | Sato et al. | 361/255 X |

FOREIGN PATENT DOCUMENTS 7-281505 10/1995 Japan .

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

A charging apparatus includes a rotatable charging member, contactable to a member to be charged, for charging the member to be charged, the rotatable charging member is provided with a rotation shaft; an electroconductive elastic member for urging the rotatable charging member to the member to be charged, wherein the rotatable charging member is capable of being supplied with a voltage through the elastic member; wherein a part of the elastic member and a peripheral surface of the rotation shaft are contacted to electrically connect the elastic member with the rotation shaft.

40 Claims, 9 Drawing Sheets

CHARGING DEVICE AND PROCESS CARTRIDGE

FIELD OF THE INVENTION

The present invention relates to a charging device and a process cartridge comprising a member to be charged for charging a member to be charged such as a photosensitive member or a dielectric member.

DESCRIPTION OF THE RELATED ART

Heretofore, in an image forming apparatus such as an electrophotographic copying machine, a corona discharger is widely used as a device for charging a surface of the member to be charged such as a photosensitive member. It comprises a wire electrode opposed to a photosensitive member and a shield electrode enclosing the wire electrode, and a proper voltage is applied to charge the photosensitive member.

However, when such a corona discharger is used, there are the following problems:

(1) The voltage applied the wire electrode is as high as 4 kV–8 kV;

(2) Most of the current flows from the wire electrode to the shield electrode, and therefore, the charging efficiency is low;

(3) Ozone is produced by the corona discharge;

(4) Discharge non-uniformity tends to occur due to the contamination of the discharging wire electrode.

As a charging device wherein such problems are solved, a so-called contact charging device wherein a charging member is directly contacted to the member to be charged to charge the member to be charged, is known.

FIG. 6 is a schematic illustration of an electrophotographic apparatus using a contact charging device 122. A photosensitive drum 121 as the member to be charged rotates in the direction of arrow K1, and the charging roller 130 as the charging member, and opposite end portions of a core metal (and rotation shaft) 131, are supported by bearings 135, and the bearings 135 are urged to the photosensitive drum 121 by springs 136 so that the charging member is press-contacted to the photosensitive drum 121 to form a contact portion (nip) n therebetween. A bias voltage is supplied to the charging roller 130 from the voltage source 138 through the contact 137, the spring 136, the bearing 135 and the core metal 131, so that the surface of the photosensitive drum 121 is charged. By exposing the charging surface to image light L, an electrostatic latent image is formed. The electrostatic latent image on the photosensitive drum 121 is visualized by a developing device 123 into a toner image Ta, and the toner image Ta is transferred onto a sheet material P by transferring means 112 as an image Tb. The sheet material P having received the image is heated by an unshown fixing device so that the toner image is fixed into a permanent image. The toner remaining on the photosensitive drum 121 after the transfer, is removed by the cleaning device 125, so that the photosensitive drum 121 is repeatedly used for image formation.

The bearings 135 supporting the opposite end portions of the core metal 131 of the charging roller 130 are made of plastic resin material. One of the bearings 135 which functions to supply the electric power to the charging roller 130 is made of a plastic resin material containing dispersed carbon fiber to provide an electroconductivity of approx. $10^3$–$10^4$ ψ-cm. Thus, the bias voltage is applied to the charging roller 130 from the voltage source 138 through the electroconductive contact 137, spring 136, bearing 135 and core metal 131.

However, in such a charging device, the state of dispersion of the carbon fiber in the plastic resin material varies depending on the molding condition with the result of high resistance value exhibiting insulation in some cases. If this occurs, the photosensitive member is not charged to the predetermined potential with the result of an image defect.

SUMMARY OF THE INVENTION

Accordingly, it is a principal object of the present invention to provide a charging device and process cartridge wherein a conduction defect is prevented in a voltage supply path to a rotatable charging member from a voltage source.

It is another object of the present invention to provide a charging device and a process cartridge wherein the voltage can be supplied properly to the rotatable charging member despite the resistance of the bearing of the rotatable charging member.

It is a further object of the present invention to provide a charging device and a process cartridge wherein the reliability of the structure of the electric energy supplying portion for supplying the voltage to the rotatable charging member is improved.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
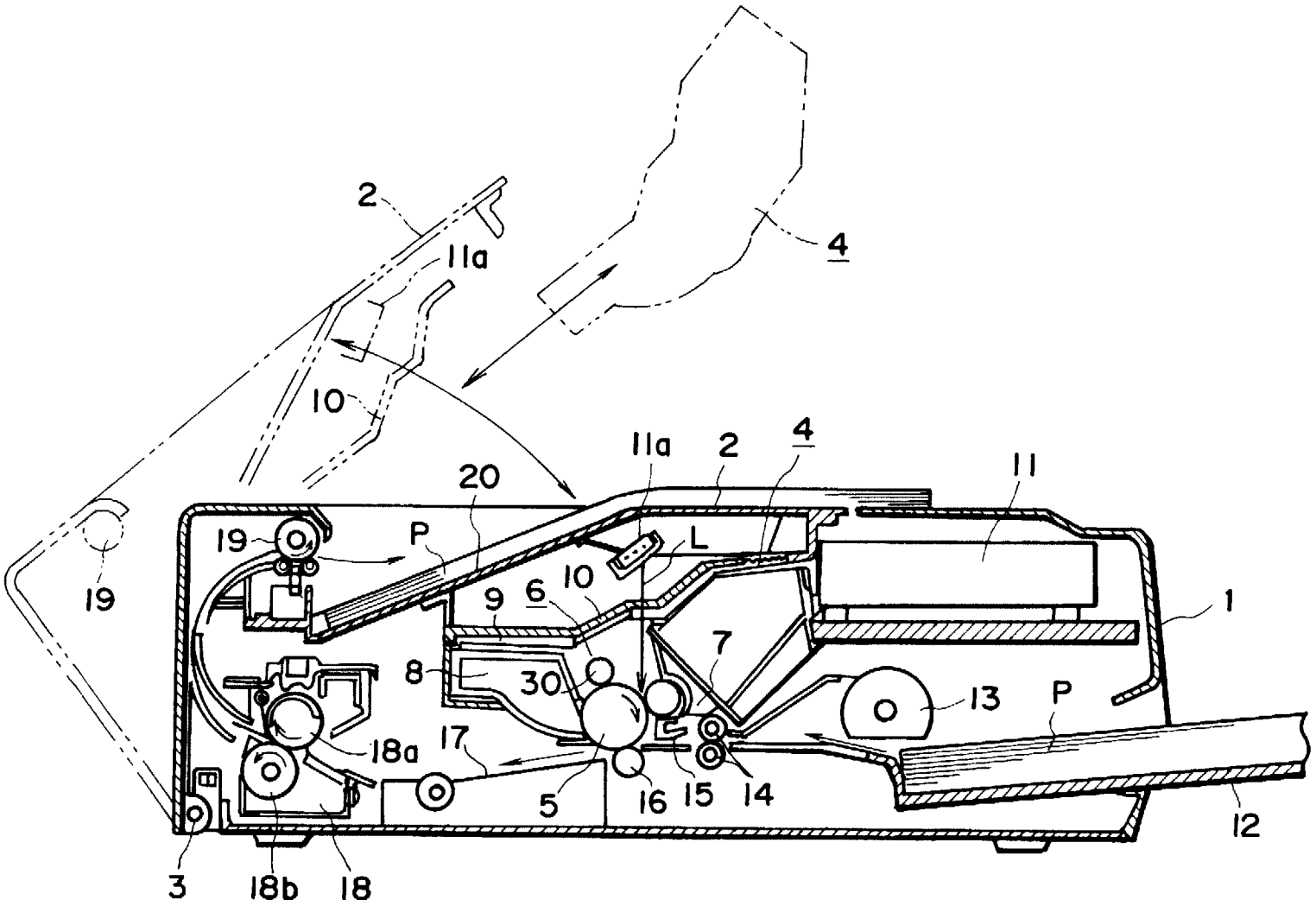
FIG. 1 is a longitudinal section of a laser beam printer as an image forming apparatus.
Figure 2:
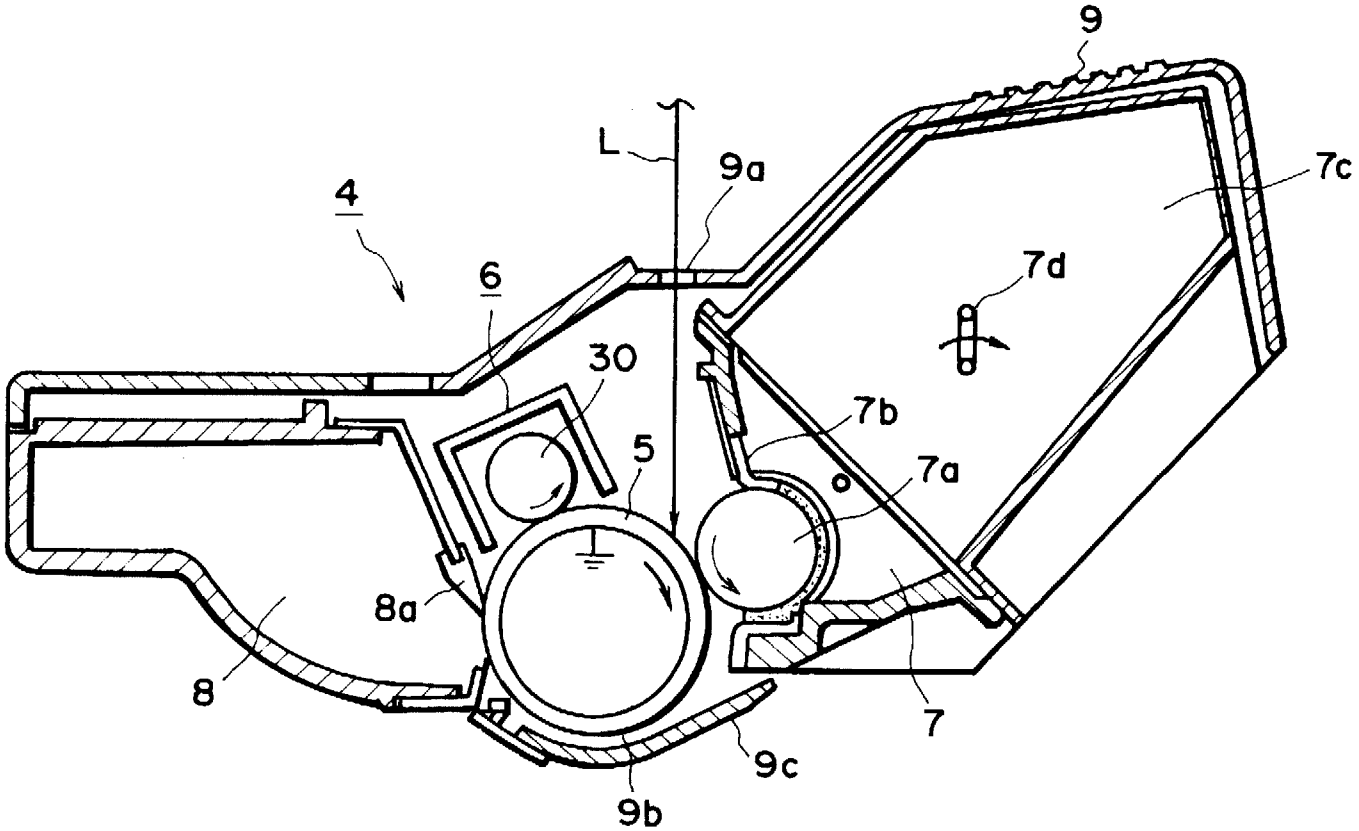
FIG. 2 is an enlarged longitudinal sectional view of a process cartridge.

FIG. 1 is a schematic illustration of an image forming apparatus using a charging device according to an embodiment of the present invention. The image forming apparatus of this example is a laser beam printer using an electrophotographic process of a mounting-and-demounting type process unit (process cartridge). FIG. 2 is an enlarged cross-sectional view of a process unit.

Designated by reference numeral 1 is a lower casing of the printer, and 2 is an upper casing of the printer. The upper casing 2 is rotatable relative to the lower casing 1 about a hinge supporting shaft 3 between a closed position indicated by a solid line and an open position indicated by a chain line.

Designated by 4 is a process unit, and in this embodiment, it contains four process means, namely, a drum type photosensitive member 5, a charging device 6, a developing device 7 and a cleaning device 8, and is detachably mountable relative to the main assembly of the printer. The process unit 4 is loaded into the printer by opening the upper casing 2 of the printer from the lower casing 1, inserting the process unit 4 into a unit mounting portion 10, and closing the upper casing 2 to the lower casing 1. By doing so, the main assembly of the printer and the process unit 4, are mechanically and electrically coupled so that the printer becomes operable for image formation. The process unit 4 may contain the photosensitive member 5 and at least one of a charging device 6, developing device 7 and cleaning device 8.

Designated by 11 is a laser scanner unit; 12 is a sheet cassette; 13 is a sheet feeding roller; 14 is a registration roller pair; 15 is a transfer guide; 16 is a transfer roller as a transfer charger; 17 is a feeding member; and 18 is a fixing device. They are contained in the lower casing 1 side of the printer. By this, an electrostatic latent image corresponding to the intended image information is formed on the surface of the photosensitive member 5. Upon a print start signal, the photosensitive member 5 is rotated with a predetermined peripheral speed (process speed) in the clockwise direction indicated by the arrow, and the peripheral surface of the rotatable photosensitive member 5 is provided in contact with the charging roller 30, and the photosensitive member 5 is charged uniformly by charging roller (the charging member) 30 of a charging device 6 supplied with a bias voltage in the form of an AC biased DC voltage.

From a laser scanner unit 11, a laser beam L modulated corresponding to a time series electrical digital pixel signal of the intended image information, is emitted and is reflected by the mirror 11*a*. It then travels through the dark portion 9*a* in the frame 9 of the process unit 4 to the charged surface of the rotatable photosensitive member 5, so that the rotatable photosensitive member 5 is exposed and scanned by the laser beam L. By this, an electrostatic latent image is formed in accordance with the intended image information on the surface of the photosensitive member 5. The formed latent image is developed with toner powder supplied with a layer thickness regulated by a development blade 7*b* on a developing sleeve 7*a* of the developing device 7. The developing device 7 effects a so-called reverse development wherein the toner is deposited on the light portion of the electrostatic latent image on the photosensitive member. In the developing device 7, designated by reference numeral 7*c* is a toner container; 7*d* is a stirring member for stirring the toner in the toner container. The toner stirred in the toner container 7*c* is moved toward the sleeve 7*a*.

On the other hand, a transfer material P is fed out one by one by a sheet feeding roller 13 from a sheet cassette 12, and is fed to a transfer position between a transfer roller 16 and the photosensitive member 5 by way of a transfer guide 15 in timed relation with the emission of the laser, by a registration roller pair 14. By this, the toner powder image formed on the photosensitive member 5 is transferred onto the surface of the transfer material P. The image transfer, onto the transfer material P, of the toner image is effected electrostatically by application of a transfer bias from a transfer bias application voltage source to the transfer roller 16.

The transfer material P having received the toner powder image is separated from the surface of the photosensitive member 5, and is fed to a fixing device 18 by a feeding member 17, and is passed through a nip formed between the fixing roller 18*a* and the pressing roller 18*b*, by which the toner powder image is fixed, and then, the transfer material P is discharged to a sheet discharge tray 20 by a sheet discharging roller 19 pair. The photosensitive member 5 after the transfer, is cleaned by a cleaning device 8 so that the residual toner is removed therefrom by a blade 8*a* of the cleaning device 8, so that it is repeatedly used for image formation starting with charging. The photosensitive member 5 may be uniformly exposed between the blade 8*a* and the charging roller 30 to discharge the residual charge from the photosensitive member 5.

In FIG. 2, designated by 9*c* is a cover openable relative to the exposure opening 9*b* for the photosensitive member in the process unit 4, and it protects the photosensitive member at the closed position when the process unit 4 is out of the printer or when the upper casing 2 is opened. When the process unit 4 is mounted at the mounting position of the printer, the cover 9*c* is opened as shown in FIG. 1, to expose the lower surface of the photosensitive member 5.

Figure 3:
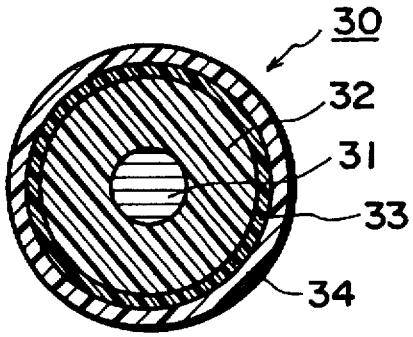
FIG. 3 is a longitudinal section of a charging roller.

FIG. 3 shows a preferable example of the charging roller 30 as the charging member. FIG. 3 is a layer structure schematic view of the charging roller 30. An electroconductive elastic layer 32 is formed on an electroconductive core metal 31 as a rotation shaft (SUS, for example), and an elastic layer 33 of a high resistance is formed thereon, and further, a protecting film 34 is formed on the surface thereof. The electroconductive elastic layer 32 is made of an EPDM (a copolymer resin material of ethylenepropylenedien) in which carbon is dispersed, and it conducts the bias voltage supplied to the core metal 31. The elastic layer 33 of high resistance is made of urethane rubber or the like, and an example thereof includes a material containing a small amount of electroconductive fine powder (carbon, for example), and it is effective, when the charging roller 30 is contacted to a high electroconductivity portion of the photosensitive member 5 (a pin hole or the like), to limit the leakage current from the roller 30 to the photosensitive member 5 to prevent a sudden drop of the bias voltage. The surface protecting film 34 is made of N-methylmethoxy Nylon and is effective to protect the surface of the photosensitive member 1 to prevent alteration of the surface of the photosensitive member 1 by contact, to the photosensitive member 5, of composition of the high resistance elastic layer 33 or the electroconductive elastic layer 32.

Embodiment 1

Figure 4:
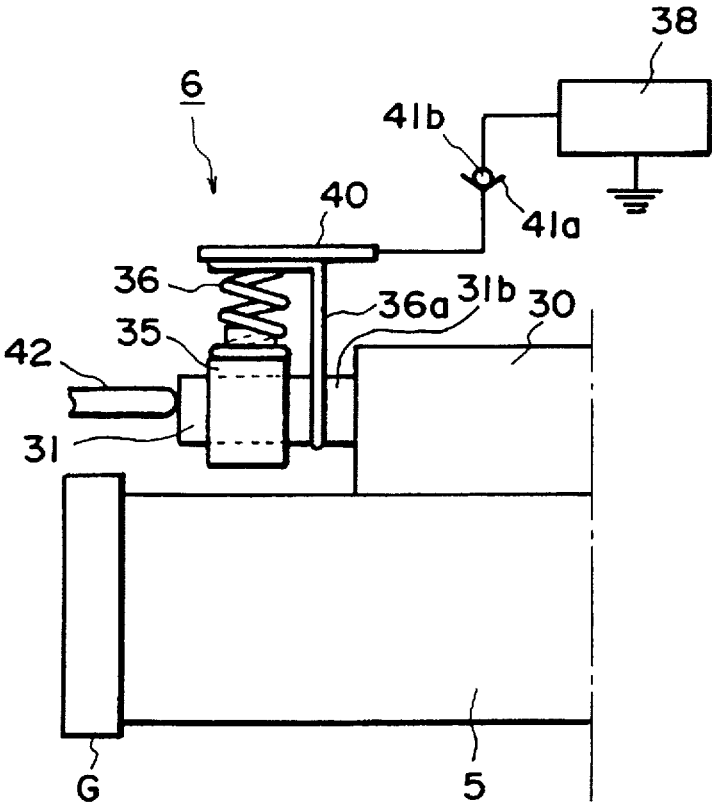
FIG. 4 is a front view showing a structure of the electric energy supply portion in embodiments 1 and 3.

FIG. 4 shows the longitudinal end portion of charging roller 30, more particularly the structure of the electric energy supply portion for the roller 30. The photosensitive member 5 is rotatably supported by bearings between the side plates of a process unit frame (9). Designated by G is a drum gear provided concentrically and integrally with the photosensitive member 5. When the process unit 4 is mounted to a predetermined position of the main assembly of the printer, the gear G is engaged with a driving gear (not shown) of the main assembly side so that the rotating force of the driving gear is transmitted to the photosensitive member 5 through the gear G to rotate the photosensitive member 5.

A rotation shaft in the form of a core metal 31 of the charging roller 30 as the charging member is supported by insulative bearings at opposite end portions thereof. The charging roller 30 is biased to the photosensitive member 5 by coil-like springs 36 as an electroconductive elastic member made of SUS (stainless steel) or the like compressed between the bearing and unshown process unit frame (9), so that it is press-contacted to the photosensitive member 5. Charging roller 30 is rotated by rotation of the photosensitive member 5. The bearing 35 is guided by an unshown guiding member so that the roller 30 is movable toward and away from the photosensitive member 5.

The end surfaces of the core metal 31 are contacted by thrust stoppers 42 (only one side is shown) formed integrally with the frame of the process unit 4 in the axial direction of the charging roller 30 so that the axial movement of the charging roller 30 is limited. The thrust stopper 42 is made of insulative resin material integral with the frame of the process unit 4.

A spring end surface 36*a* extended from the coil spring 36 is press-contacted to the peripheral surface 31*b* of the shaft of the core metal 31. A base end portion of the electrode 40 is fixed to the main assembly of the cartridge by heat crimp or the like. When the process cartridge 4 is mounted to a predetermined position of the main assembly of the printer, a receiving contact 41*a* of the process cartridge 4 side is contacted to the electric energy supply contact 41*b* of the main assembly side of the printer, so that the voltage source 38 in the main assembly and the electrode 40 in the process cartridge 4 are electrically connected.

In the electric energy supply portion shown in FIG. 4, a base end portion of the electrode 40 is bent toward the upper end side of the spring 36, and is crimped on the main assembly of the cartridge and the upper end portion of the spring 36 is contacted and stopped by the folded and extended portion of the electrode 40. The spring 36 is electroconductive, and the bearing 35 is insulative. Therefore, the electrode 40 and the core metal 31 are electrically connected through the spring 36.

The bias voltage of the voltage source 38 is directly supplied by the peripheral surface 31*b* of the shaft of the electroconductive core metal 31 of the charging roller 30 through one portion of the electrode 40 and the electroconductive spring 36. By doing so, the conduction property of the electric supply path from the voltage source 38 to the charging roller 30 is improved, so that the charging defect of the photosensitive member 5 due to the conduction defect, and the charging defect and the resultant image defects, can be avoided, and therefore, the cost reduction is accomplished. Since the electric energy supply to the charging roller 30 is effected directly by the core metal 31, and therefore, the bearing is not required to be electroconductive. Additionally, there is no need for the plastic resin material of the bearing 35 to contain carbon, and the cost of the bearing can be reduced.

Figure 5:
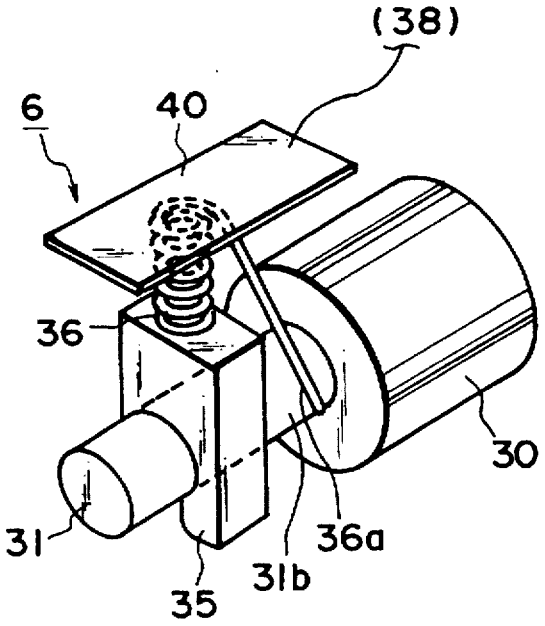
FIG. 5 is a perspective view of an electric energy supply portion of FIG. 4.
Figure 6:
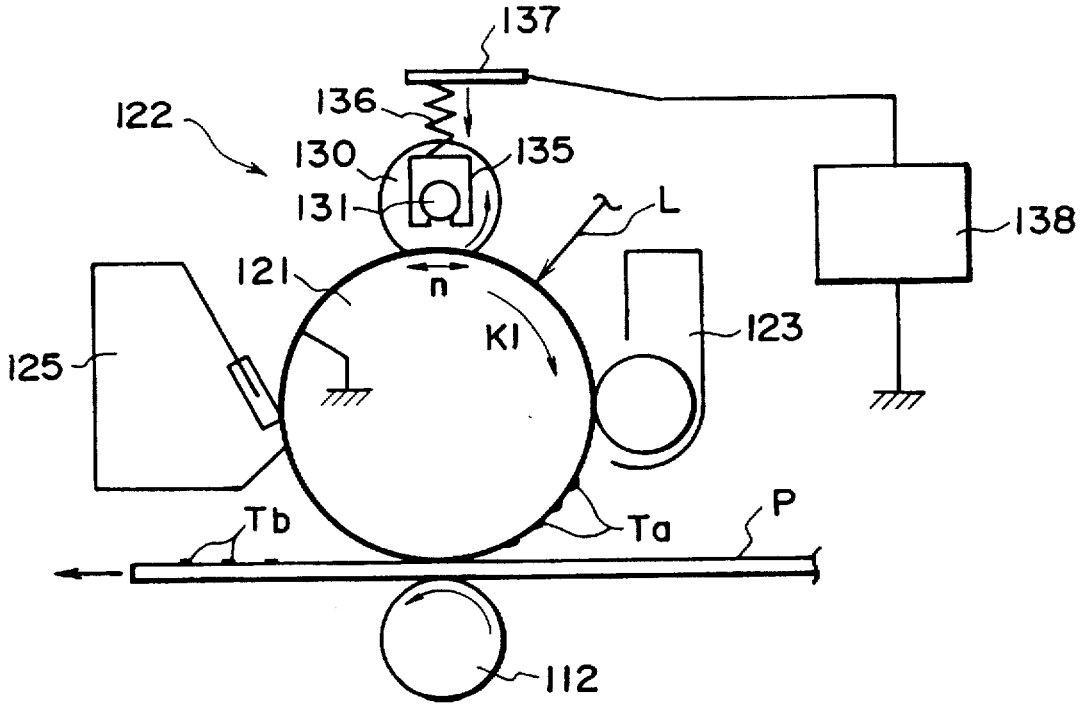
FIG. 6 PRIOR ART
FIG. 6 is a longitudinal sectional view showing a conventional image forming apparatus.

FIG. 5 is a perspective view of a major part of the end portion of the charging device. A spring end surface 36*a* extended out of the spring 36 for urging the charging roller 30 toward the photosensitive drum 5, is press-contacted to the peripheral surface 31*b* of the shaft of the core metal 31 of the charging roller 30. In this example, the core metal 31 and spring 36 are made of SUS (stainless steel) as a common material. When the same materials are contacted, an oxide film is not easily formed at the contact portion.

Figure 10:
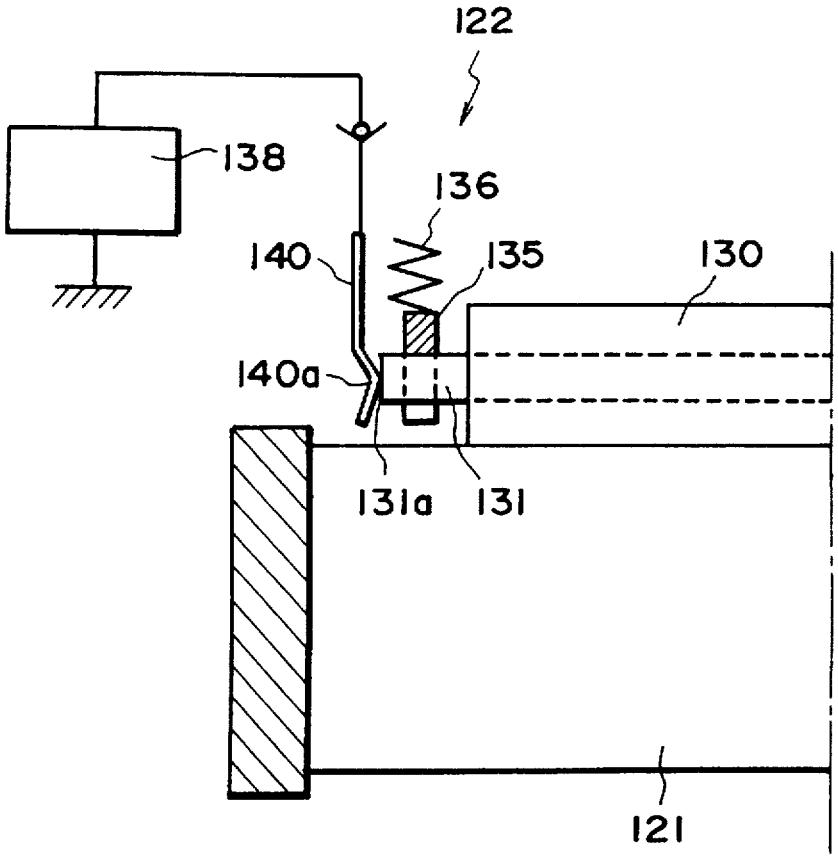
FIG. 10 PRIOR ART
FIG. 10 is a front view of a conventional electric energy supply portion.

On the other hand, FIG. 10 shows a method for applying a bias voltage in another way. A bias voltage of the voltage source 138 is applied to an electrode 140 made of a phosphor bronze plate, and a leading end portion 140*a* of the electrode 140 is contacted to an end surface 131*a* of the core metal 131 made of SUS, and therefore, the electric energy supply to the charging roller 130 can be effected directly. The charging roller 130 is urged to the photosensitive member 121 by the spring 136 urging the bearing 135.

In the case of the FIG. 10 arrangement, when the charging roller 130 is moved in the axial direction, the core metal 131 may be contacted improperly with the leading end portion 140*a*, or may deform the leading end portion 140*a*. An insulative oxide film is produced between the electrode 140 made of the phosphor bronze plate and the core metal 131 made of SUS, a conduction defect may occur.

However, in this example, the conduction is established between a part 36*a* of the spring 36 and the peripheral surface 31*b* of the core metal 31, and therefore, the conduction defect does not easily occur even if the core metal 31 moves in the axial direction. Since the electrode 40 and the core metal 31 are made of the same material, the insulative oxide film is not easily produced.

Embodiment 2

The description will be made as to embodiment 2 of an electric energy supply method in a charging device, referring to FIG. 7–FIG. 9.

Figure 7:
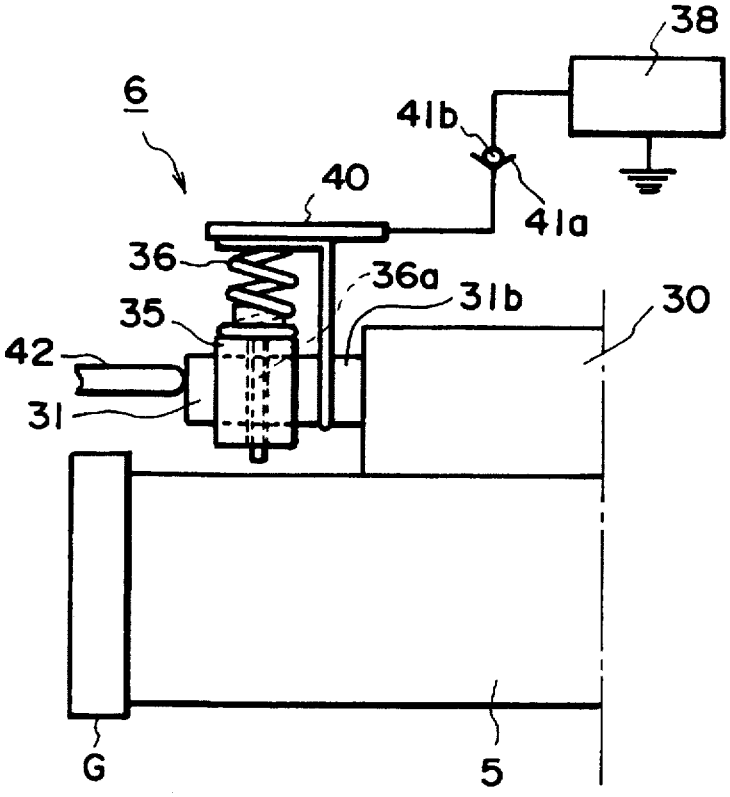
FIG. 7 is a front view showing an electric energy supply portion in embodiments 2 and 4.

FIG. 7 shows a structure of an electric energy supply portion relative to a charging roller 30. The photosensitive member 5 is rotatably supported by bearings between the side plates of a process unit frame (9). Designated by G is a drum gear provided concentrically and integrally with the photosensitive member 5. When the process unit 4 is mounted to a predetermined position of the main assembly of the printer, the gear G is in engagement with a driving gear (not shown) of the main assembly side so that the rotating force of the driving gear is transmitted to the photosensitive member 5 through the gear G to rotate the photosensitive member 5.

A rotation shaft in the form of a core metal 31 of the charging roller 30 as the charging member is supported by insulative bearings at the opposite end portions thereof. The charging roller 30 is biased to the photosensitive member 5 by coil springs 36 as an electroconductive elastic member made of SUS (stainless steel) or the like contraction provided between the bearing and unshown process unit frame (9), so that it is press-contacted to the photosensitive member 5. The charging roller 30 is rotated by rotation of the photosensitive member 5. The end surfaces of the core metal 31 are contacted by thrust stoppers 42 (only one side is shown) formed integrally with the frame of the process unit 4 in the axial direction of the charging roller 30, so that the axial movement of the charging roller 30 is limited.

As shown in FIG. 7, a spring end surface 36*a* extended from the coil spring 36 is press-contacted to the peripheral surface 31*b* of the shaft of the core metal 31. A base end portion of the electrode 40 is fixed to the main assembly of the cartridge by heat crimp or the like. When the process cartridge 4 is mounted to a predetermined position of the main assembly of the printer, a receiving contact 41*a* of the process cartridge 4 side is contacted to the electric energy supply contact 41*b* of the main assembly side of the printer, so that the voltage source 38 in the main assembly and the electrode 40 in the process cartridge 4 are electrically connected. The core metal and the electrode 40 are electrically connected through a spring 36 (spring end portion 36*a*).

The bias voltage of the voltage source 38 is directly supplied by the peripheral surface 31*b* of the shaft of the electroconductive core metal 31 of the charging roller 30 through one portion of the electrode 40 and the electroconductive spring 36. By doing so, the conduction property of the electric supply path from the voltage source 38 to the charging roller 30 is improved, so that the charging defect of the photosensitive member 5 due to the conduction defect, and the charging defect and the resultant image defects, can be avoided, and therefore, the cost reduction is accomplished.

Figure 8:
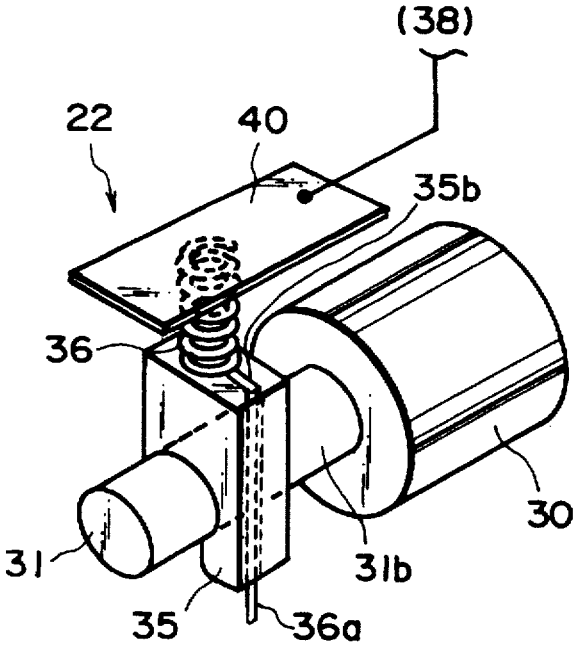
FIG. 8 is a perspective view of an electric energy supply portion of FIG. 7.
Figure 9:
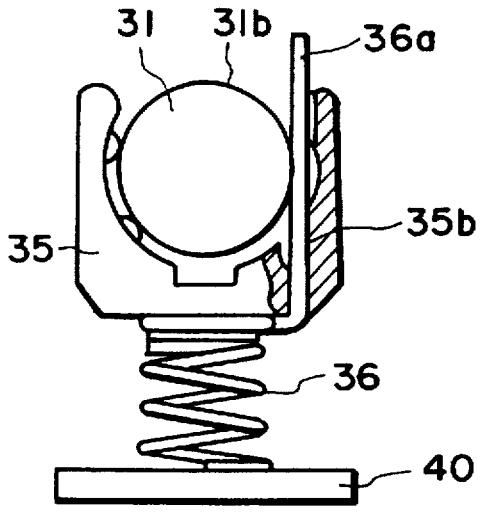
FIG. 9 is a detailed illustration showing a structure of an electric energy supply portion of FIG. 7.

FIG. 8 is a perspective view of an end portion of the charging device of FIG. 7, and FIG. 9 is a detailed drawing of an example wherein the insulative bearing 35 functions for positional limitation of the electroconductive spring 36. A spring end surface 36*a* extended out of the spring 36 for urging the charging roller 30 toward the photosensitive drum 5, is press-contacted to the peripheral surface 31*b* of the shaft of the core metal 31 of the charging roller 30, and in this case, the pressing contact is effected through the hole 35*b* of the electroconductive bearing 35. With this structure, the positional limit for the end surface 36*a* of the spring is effected, and the electric energy supply is directly effected to the peripheral surface 31*b* of the shaft of the core metal 31 of the charging roller 30, by which the conduction property of the electric supply path from the voltage source 38 to the charging roller is improved and stabilized, so that the charging defect of the photosensitive member 5 due to the conduction defect and the image defect due to the charging defect can be prevented.

The electric energy supply to the charging roller 30 is directly effected by the core metal 31 through the spring 36, and therefore, the bearing 35 is not required to be electroconductive. Additionally, there is no need for the plastic resin material of the bearing 35 to contain carbon, so that the cost of the bearing can be reduced.

Embodiment 3

A third embodiment of the charging device will be described. In this example, the bearing 35 shown in FIGS. 4 and 5 is electroconductive. The same reference numerals as in FIGS. 4 and 5 are assigned to the elements having the corresponding functions, and detailed descriptions thereof are omitted for simplicity except for the bearing.

Since the bearing 35 is electroconductive, the electrode 40 and the core metal 31 are electrically connected through the spring 36 and the bearing 35.

With this structure, there are provided two power supply paths from the voltage source 38 to the charging roller 30, namely, a first electric energy supply path by way of the base end portion of the electrode 40, the electroconductive spring 36, and the electroconductive bearing 35, and a second electric energy supply path by way of the base end portion of the electrode 40, end surface 36*a* of the spring extended from the electroconductive spring 36, and the peripheral surface 31*b* of the shaft of the core metal 31 of the charging roller 30. Therefore, even if the resistance value is high due to the molding condition of the electroconductive bearing 35 with the result of difficulty in supplying power to the charging roller 30, the photosensitive drum 121 can be charged properly through the second electric energy supply path, so that the charging property and reliability is improved and stabilized. Since the end surface 36*a* of the extended electroconductive spring 36 is directly in electric connection with the peripheral surface 31*b* of the shaft of the core metal 31 of the charging roller 30, the conduction defect resulting from insulative oxide film generation due to long term non-use or the like, or electrode deformation at the time of the assembling operation, can be suppressed, as compared with the conventional structure wherein a tip end portion 140*a* of the electrode 140 made of phosphor bronze plate or the like is contacted to the end surface 131*a* of the core metal 131 of the charging roller 130 made of SUS.

According to this embodiment, the cost is lower than in the conventional structure, and the axial movement of the charging roller can be eliminated.

Embodiment 4

A charging device of embodiment 4 will be described. In this embodiment, the bearing 35 shown in FIG. 7–FIG. 9 is electroconductive. The same reference numerals as in FIGS. 7–9 are assigned to the elements having the corresponding functions, and detailed descriptions thereof are omitted for simplicity.

The bearing 35 is electroconductive, and therefore, the electrode 40 and the core metal 31 are electrically connected through the spring 36 and the bearing 35.

With this structure, there are provided two power supply paths from the voltage source 38 to the charging roller 30, namely, a first electric energy supply path by way of the base end portion of the electrode 40, the electroconductive spring 36, and the electroconductive bearing 35, and a second electric energy supply path by way of the base end portion of the electrode 40, end surface 36*a* of the spring extended from the electroconductive spring 36, and the peripheral surface 31*b* of the shaft of the core metal 31 of the charging roller 30.

Therefore, even if the resistance value is high due to the molding condition of the electroconductive bearing 35 with the result of difficulty in supplying power to the charging roller 30, the photosensitive drum 21 can be charged properly through the second electric energy supply path, so that the charging property and reliability is improved and stabilized. Since the end surface 36*a* of the extended electroconductive spring 36 is directly in electric connection with the peripheral surface 31*b* of the shaft of the core metal 31 of the charging roller 30, the conduction defect resulting from insulative oxide film generation due to long term non-use or the like, or electrode deformation at the time of assembling operation can be suppressed, as compared with the conventional structure wherein a tip end portion 140*a* of the electrode 140 made of phosphor bronze plate or the like is contacted to the end surface 131*a* of the core metal 131 of the charging roller 130 made of SUS.

According to this embodiment, the cost is lower than in the conventional structure, and the axial movement of the charging roller can be eliminated.

As shown in FIGS. 8 and 9, a spring end surface 36*a* extended out of the spring 36 for urging the charging roller 30 toward the photosensitive drum 5, is press-contacted to the peripheral surface 31*b* of the shaft of the core metal 31 of the charging roller 30, and in this case, the pressing contact is effected through the hole 35*b* of the electroconductive bearing 35. With this structure, the positional limit for the end surface 36*a* of the spring is effected, and a plurality of electric energy supply paths are provided, so that the charging property, reliability and stability are improved, and in addition, the electrode deformation which may be possible when the other parts are mounted, is prevented, and the low cost, and the axial movement prevention of the charging roller, can be accomplished.

According to embodiments 3 and 4, the redundant electric energy supply paths assure the electric energy supply.

Figure 11:
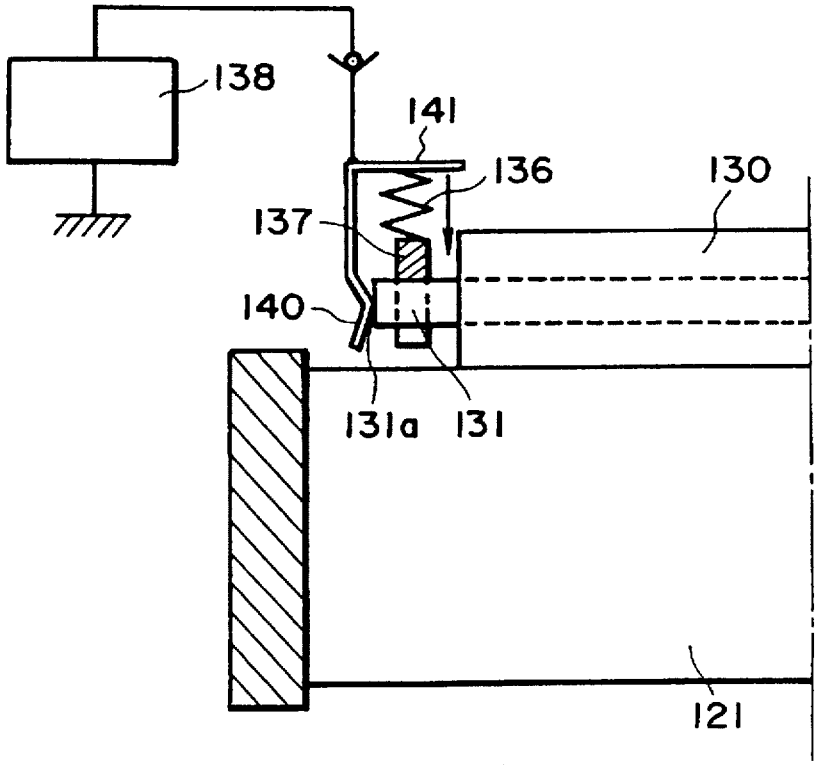
FIG. 11 PRIOR ART
FIG. 11 is a schematic view of a major part of a conventional charging device.

FIG. 11 shows a comparison example of the electric energy supply portion in a charging device.

The bearings 137 at the opposite end sides of the charging roller 130, are made of plastic resin material, and one of them which functions to supply the electric power to the charging roller 130 is made of the material in which carbon fiber is dispersed, so that it is electroconductive. The spring 136 at this electroconductive bearing side is compressed between the electroconductive bearing 137 and the electrode plate 141 provided on the lower surface of an unshown stationary member thereabove. The spring 136 is electroconductive. The electrode plate 141 is extended and bonded downwardly to provide an elastic contact part 140, which is elastically press-contacted to the end surface 130 of the charging roller core metal at the electric energy supply side. The electrode plate 141 is connected to the charging bias application voltage source 138. The materials of the electrode plate 141 and the contact plate 131*a* are stainless steel, for example.

When the photosensitive drum 121 is rotated, and the charging roller 130 is rotated thereby, a predetermined charging bias is applied to the charging plate 141 from the voltage source 138.

a) The charging bias is applied to the charging roller 130 through the electrode plate 141, electroconductive spring 136, electroconductive bearing 137, and the charging roller core metal 131 (first electric energy supply path).

b) The charging bias is applied through the electrode plate 141, the elastic contact plate 140, the charging roller core metal end surface 131*a*, and the charging roller core metal 131 (second electric energy supply path).

When the electric energy supply defect to the charging roller 130 occurs, the photosensitive drum 121 cannot be charged to the predetermined potential, with the result of image defect. By providing a) a first electric energy supply path and b) a second electric energy supply path, the application of the charging bias to the charging roller 130 is assured even if one path fails, since the other path backs up.

The conduction defect of the electric energy supply path may result from the electroconduction defect of the electroconductive bearing 137 in the first electric energy supply path. This is because the dispersion state of the carbon fiber may vary depending on the conditions.

In the case of the second electric energy supply path, the conduction defect may result from the resistance increase at the mutual sliding contact portion between the elastic contact plate 140 and the end surface 131*a* of the charging roller core metal due to the oxide coating produced during long term non-use. When the other parts are mounted, the elastic contact plate 140 may be deformed with the result of improper contact between the elastic contact plate 140 and the charging roller core metal end surface 131*a*, in some cases. In the case of the structure wherein the elastic contact plate 140 is elastically press-contacted to the core metal end surface 131*a* of the charging roller 130 which is rotating, noise tends to be produced. To avoid this, it is inevitable to apply electroconductive grease.

Therefore, it is preferable to use both of the first electric energy supply path through the electrode, the electroconductive spring and the electroconductive bearing, and the second electric energy supply path through the electrode and the spring end surface extended from the electroconductive spring as in embodiments 3 and 4, which have been described hereinbefore.

Embodiment 5

The description will be made as to another example of an electric energy supply portion of a charging device provided with first and second electric energy supply paths.

Figure 12A:
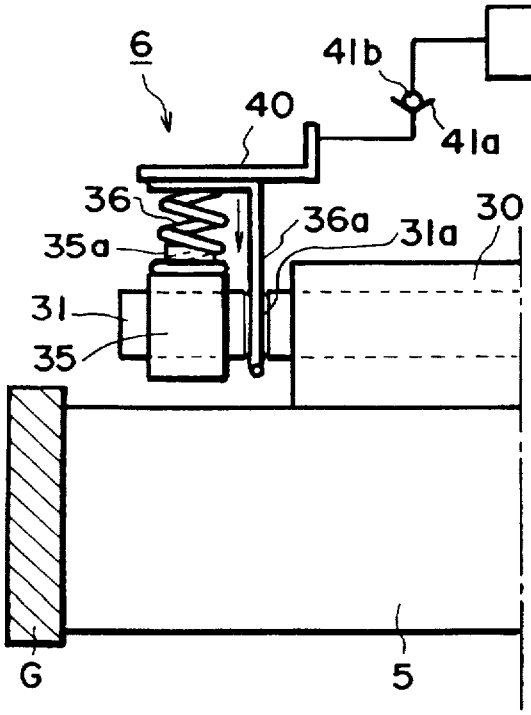
FIGS. 12(*a*) and (*b*) are structure illustrations of a charging device in embodiment 5.
Figure 12B:
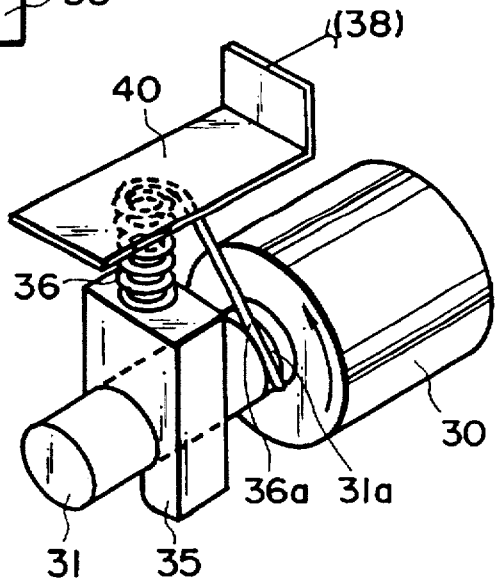

In this embodiment, as shown in FIG. 12, (*a*) and (*b*), the core metal 31 is provided with a groove 31*a* for engagement with an extension 36*a* of the coil spring 36. The structure of the charging roller 30 is as shown in FIG. 3.

Opposite end exposed portions of the core metal 31 penetrating the center of charging roller 30 is rotatably supported by reversed U-shaped bearings 35. Each bearing 35 is engaged with a vertical guide hole provided in an unshown cartridge frame so as to be movable toward and away from the photosensitive drum 5. A coil spring (elastic member) 36 is compressed between each bearing 35 and unshown stationary member thereabove to urge each bearing 35 downwardly, so that the charging roller 30 is contacted to the surface of the photosensitive drum 5 against the elasticity of the elastic layer 32 with a predetermined urging force. Designated by 35*a* is a dowel portion formed in an upper surface of the bearing 35, and a bottom end of the coil spring 36 is engaged in the dowel portion, and the coil spring 36 is fixed on the upper surface of the bearing 35.

The photosensitive drum 5 is rotatably supported by bearings between unshown cartridge side plates. One end thereof is provided with a drum gear G to which rotating force is transmitted from an unshown driving mechanism so that the photosensitive drum 5 is rotated at a predetermined peripheral speed in a predetermined direction. The charging roller 30 is rotated by the photosensitive drum 5.

The bearings 35 at the opposite end sides of the charging roller 30, are made of plastic resin material, and one of them which functions to supply the electric power to the charging roller 30 is made of the material in which carbon fiber is dispersed, so that it is made electroconductive. A coil spring 36 at the electroconductive bearing side is electroconductivity and is compressed between the electroconductive bearing 35 and the electrode plate 40 fixed by crimping or the like to the lower surface of an unshown stationary member thereabove.

The upper end of the coil spring 36 is downwardly extended, and the extended portion 36*a* of the spring wire material is received by an annular engagement groove 31*a* formed in a peripheral surface of the shaft in the charging roller core metal 31 exposed portion adjacent to the coil spring 36 side and is press-contacted elastically to the peripheral surface of the shaft of the charging roller core metal exposed portion. It is preferable to provide a thrust stopper 42 shown in FIG. 4 to prevent movement of the core metal 31 in the axial direction.

Designated by 38 is a charging bias application voltage source at the main assembly side of the printer. When the printer is mounted to the main assembly of the printer, the receiving contact 41*a* in the process cartridge is brought into contact with the electric energy supply contact 41*b* in the main assembly of the printer to establish an electrical connection between the voltage source 38 in the main assembly and the electrode plate 40 in the process cartridge 4.

Then, the photosensitive drum 5 is rotated, and the charging roller 30 is rotated thereby. The predetermined charging bias is applied to the charging plate 40 from the voltage source 38, so that the charging roller 30 is supplied with the charging bias through a first electric energy supply path including the electrode plate 40, the electroconductive coil spring 36, the electroconductive bearing and the charging roller core metal 31.

The charging bias is applied to the charging roller 30 also through the second electric energy supply path including the electrode plate 40, the coil spring 36, the extended portion 36*a* of the upper end side of the coil spring, and the peripheral surface of the shaft at the exposed portion of the charging roller core metal 31.

Therefore, if the electric energy supply through the first electric energy supply path system fails due to a high resistance value of the electroconductive bearing or the like, the provision of the second electric energy supply path assures the supply of the electric power to the charging roller 30, thus assuring the charging of the photosensitive drum 5.

In the second electric energy supply path, a part 36*a* of the electroconductive coil spring 36 which urges the charging roller 30 to the photosensitive drum 5 is contacted to the peripheral surface of the shaft of the rotation shaft 31 of the charging roller 30, so that the charging roller 30 and the electrode 40 are electrically connected through a part 36*a* of the electroconductive coil spring 36, and therefore, the conduction defect resulting from the oxide coating produced by long non-use term or the like, noise generation at the electrode leading edge during the electric energy supply, can be prevented, and the necessity of electroconductive grease application, and electrode deformation upon mounting of the other parts can be avoided, as contrasted to the conventional structure (FIG. 11) wherein an elastic contact plate 140 is elastically press-contacted to the end surface 131*a* of the core metal of the charging roller 130.

Since the extension 36*a* of the electroconductive coil spring 36 is engaged with the annular engagement groove 31*a* formed in the peripheral surface of the shaft of the charging roller core metal portion 31 to elastically press-contact it to the peripheral surface of the shaft, the position of the extension 36*a* can be limited. This improves the contact state as compared with a conventional example wherein the elastic contact plate 140 is elastically press-contacted to the end surface 131*a* of the core metal of the charging roller 130. Additionally, the conduction defect resulting from the oxide coating produced by long-term non-use or the like, noise generation at the electrode leading edge during the electric energy supply, can be prevented, and the necessity of electroconductive grease application, and electrode deformation upon mounting of the other parts can be avoided.

The elimination of the electric energy supply through the end surface 131*a* of the core metal of the rotatable charging roller 30 is effective to reduce the required longitudinal space, thus permitting downsizing of the cartridge 4.

Therefore, in the image forming apparatus and the process cartridge provided with such a charging device, the charging of the image bearing member as the member to be charged is effected satisfactorily so that image defect due to improper charging can be prevented.

Embodiment 6

Figure 13A:
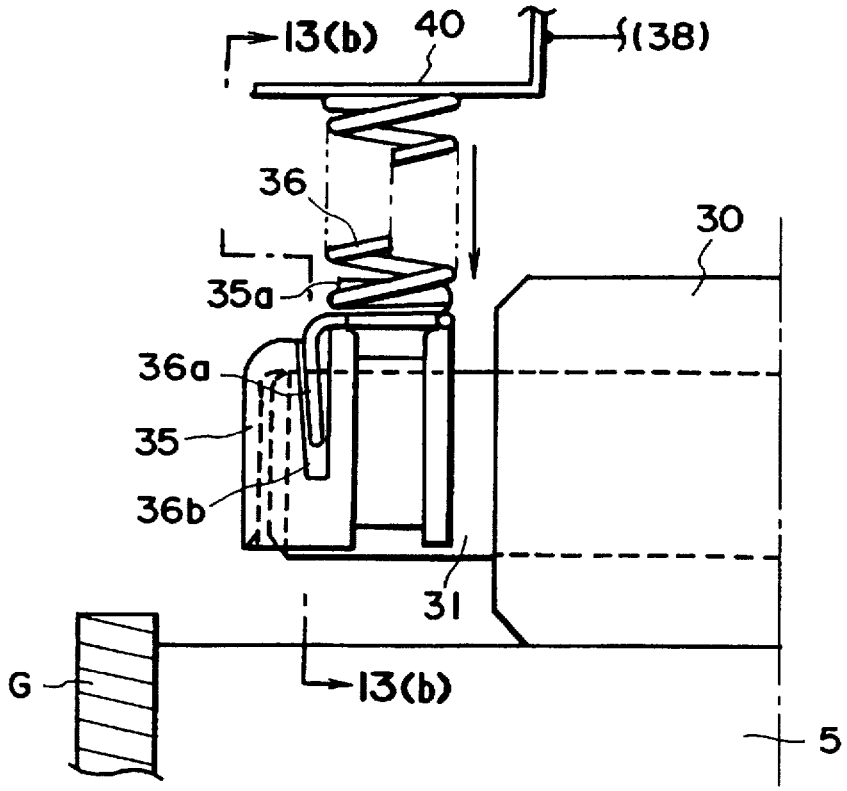
FIGS. 13(*a*) and (*b*) are illustrations of a charging device in embodiment 6.
Figure 13B:
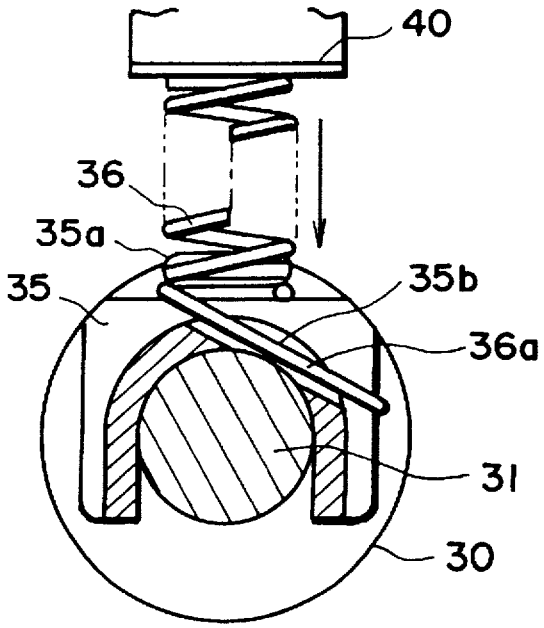

FIG. 13 is an illustration of a device according to embodiment 6, and (a) is a side view of the bearing at the electric energy supply side, and (b) is a view taken along a line 13*b*—13*b* line in (a).

In this embodiment, the spring wire material is extended downwardly at the bottom end of the electroconductive coil spring 36, and the extended portion 36*a* is received by a groove 35*b* formed in the electroconductive bearing 35 at the coil spring 36 side so that it is press-contacted elastically to the peripheral surface of the shaft of the charging roller core metal 31 in the groove portion. In this embodiment, too, there are provided:

a) A first electric energy supply path through the electrode plate 40, the electroconductive coil spring 36, the electroconductive bearing and the charging roller core metal 31; and b) A second electric energy supply path through the electrode plate 40, the extension 36*a* of the spring wire material at the bottom end of the electroconductive coil spring 36, the peripheral surface of the shaft of the charging roller core metal portion 31.

The extended portion 36*a* of the second electric energy supply path is engaged in the groove 35*b* formed in the electroconductive bearing, and in the groove portion, it is elastically press-contacted to the peripheral surface of the shaft of the charging roller core metal 31, so that the extended portion 36*a* of the spring wire material is limited in the position thereof, thus improving the contact state and the stability. It is preferable to prevent axial movement of the core metal 31, so a thrust stopper 42 is provided as shown in FIG. 4 to abut the end surface of the bearing 35 to the stopper 42.

Therefore, in this embodiment, similarly to embodiment 5, a plurality of electric energy supply paths are provided, and therefore, the charging property and the reliability are improved and stabilized. Additionally, the conduction defect resulting from the oxide coating produced by long-term non-use or the like, and noise generation at the electrode leading edge during the electric energy supply, can be prevented, and the necessity of electroconductive grease application, and electrode deformation upon mounting of the other parts can be avoided.

Embodiment 7

Figure 14A:
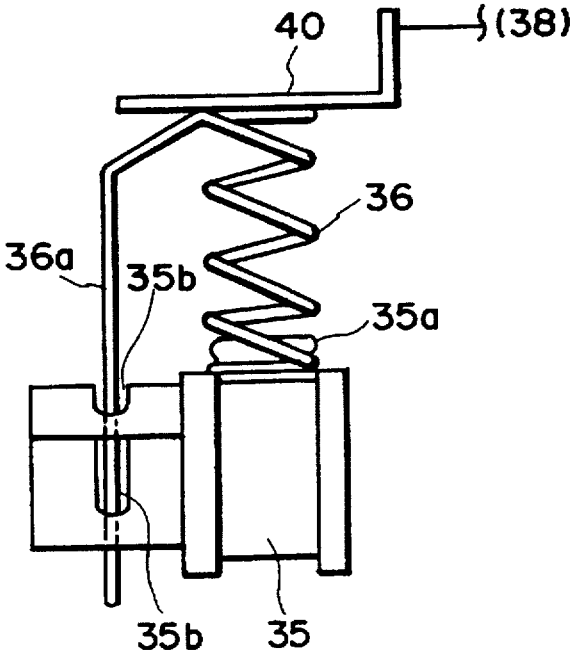
FIGS. 14(*a*) and (*b*) are illustrations of a charging device in embodiment 7.
Figure 14B:
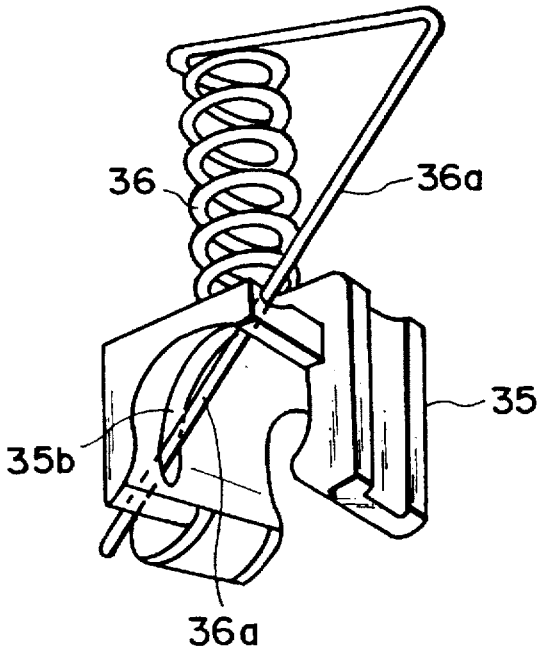

FIG. 14 shows a major part of a device of embodiment 7, and (a) is a side view of a coil spring portion and a bearing at the electric energy supply side, and (b) is a perspective view thereof. In FIG. 14, the charging roller 30 is omitted for simplicity.

Similarly to embodiment 6, a groove 35*b* is formed in the electroconductive bearing and an extended portion 36*a* of the electroconductive coil spring 36 is engaged therewith so that the spring wire material of the electroconductive coil spring 36 is press-contacted to the peripheral surface of the charging roller core metal 31 in the groove portion. However, this embodiment is different from embodiment 6 in that the spring wire material of the electroconductive coil spring 36 is extended from the top thereof.

This structure is also effective to provide the similar effects.

Other Embodiments

1) The electric energy supply path to the charging member 30 from the electrode 40 connected to the voltage source 38 may also contain third and/or fourth or the like electric energy supply paths in addition to the first and second electric energy supply paths. In this case, the electrode 40 may be common to all, but may be separate.

2) The charging member 30 may be a rotatable charging member such as a furbrush roller or magnetic brush roller other than a charging roller.

3) The applied charging bias to the charging member 30 may contain only DC voltage (DC application type), or may be an AC biased DC voltage (AC application type).

4) The image formation process of the image forming apparatus is not limited to the electrophotographic process, but may be an electrostatic recording process using a dielectric member as the image bearing member, if it includes a charging step for the image formation process.

5) The combination of the process means included in the process cartridge 4 may be different. Other examples include a combination of image bearing member 5, charging member 30, image bearing member 5 and developing device 7, a combination of image bearing member 5, charging member 30 and the developing device 7, a combination of image bearing member 5, cleaning device 8, image bearing member 5, charging member 30 and cleaning device 8, or a combination of image bearing member 5, developing device 7, cleaning device 8 or the like.

6) In embodiments 6 and 7, the following structure is an alternative. The extended portion 36*a* of the spring wire material is received by the groove 35*b* formed in an electroconductive bearing, and is further received by a groove 312 formed in the peripheral surface of the shaft of the charging roller core metal portion 31 correspondingly to the position of the groove 35*b* of the electroconductive bearing 35. It is elastically press-contacted to the electroconductive bearing of this embodiment.

Various dimensions and values of the coil spring 36 as the elastic member are given in the following:

Wire diameter of the spring wire material: 0.3–0.7 mm

Inner diameter of the coil spring: 2.0–5.0 mm

Pressure: 100–700 gr

Force by the extended portion 36*a* of the spring wire material: 20–200 gr

The elastic member 36 is not limited to a coil spring, but another elastic member such as a leaf spring is usable.

While the invention has been described with reference to the structures disclosed herein, it is not confined to the details set forth and this application is intended to cover such modifications or changes as may come within the purposes of the improvements or the scope of the following claims.

What is claimed is:

1. A charging apparatus comprising:

a rotatable charging member, contactable to a member to be charged, for charging the member to be charged, said rotatable charging member being provided with a rotation shaft;

a bearing member for receiving said rotation shaft; and an electroconductive elastic member for urging said bearing member to thereby urge said rotatable charging member to the member to be charged, wherein said rotatable charging member is capable of being supplied with a voltage through said elastic member, and wherein a part of said elastic member and a peripheral surface of said rotation shaft are contacted to electrically connect said elastic member with said rotation shaft.

2. An apparatus according to claim 1, wherein said bearing member is insulative.

3. An apparatus according to claim 1, wherein said bearing member is electroconductive, and wherein said rotation shaft and said elastic member are electrically connected through said bearing member.

4. An apparatus according to claim 1 or 3, further comprising regulating means for regulating a position of a part of said elastic member in contact with said peripheral surface of said rotation shaft.

5. An apparatus according to claim 4, wherein said regulating means is provided in said bearing member.

6. An apparatus according to claim 5, wherein said regulating means is in the form of a hole formed in said bearing member to permit penetration of said part of said elastic member.

7. An apparatus according to claim 4, wherein said regulating means is provided in said peripheral surface of said rotation shaft.

8. An apparatus according to claim 7, wherein said regulating means is in the form of an annular engagement groove formed in said peripheral surface of said rotation shaft to engage with said part of said elastic member.

9. An apparatus according to claim 1, further comprising an electrode member for electrically connecting said elastic member with a voltage source for supplying the voltage.

10. An apparatus according to claim 1, wherein said elastic member is in the form of a coil spring.

11. An apparatus according to claim 1, wherein said rotatable charging member is in the form of a roller.

12. A process cartridge detachably mountable to an image forming apparatus, said process cartridge comprising:

a member to be charged that is capable of bearing an image;

a rotatable charging member, contactable to said member to be charged, for charging said member to be charged, said rotatable charging member being provided with a rotation shaft;

a bearing member for receiving said rotation shaft; and an electroconductive elastic member for urging said bearing member to thereby urge said rotatable charging member to said member to be charged, wherein said rotatable charging member is capable of being supplied with a voltage through said elastic member, and wherein a part of said elastic member and a peripheral surface of said rotation shaft are contacted to electrically connect said elastic member with said rotation shaft.

13. A process cartridge according to claim 12, wherein said bearing member is insulative.

14. A process cartridge according to claim 12, wherein said bearing member is electroconductive, and wherein said rotation shaft and said elastic member are electrically connected through said bearing member.

15. A process cartridge according to claim 12 or 14, further comprising regulating means for regulating a position of a part of said elastic member in contact with said peripheral surface of said rotation shaft.

16. A process cartridge according to claim 15, wherein said regulating means is provided in said bearing member.

17. A process cartridge according to claim 16, wherein said regulating means is in the form of a hole formed in said bearing member to permit penetration of said part of said elastic member.

18. A process cartridge according to claim 15, wherein said regulating means is provided in said peripheral surface of said rotation shaft.

19. A process cartridge according to claim 18, wherein said regulating means is in the form of an annular engagement groove formed in said peripheral surface of said rotation shaft to engage with said part of said elastic member.

20. A process cartridge according to claim 12, further comprising an electrode member for electrically connecting said elastic member with a voltage source for supplying the voltage.

21. A process cartridge according to claim 12, wherein said elastic member is in the form of a coil spring.

22. A process cartridge according to claim 12, wherein said rotatable charging member is in the form of a roller.

23. A charging apparatus comprising:

a rotatable charging member, contactable to a member to be charged, for charging the member to be charged, said rotatable charging member being provided with a rotation shaft;

an electroconductive bearing member for receiving said rotation shaft, wherein said rotation shaft is electrically connected with a voltage source for supplying a voltage to said rotatable charging member through said bearing member; and an electroconductive member, disposed in contact with a peripheral surface of said rotation shaft, for electrical connection between the voltage source and said rotation shaft.

24. An apparatus according to claim 23, wherein said electroconductive member has elasticity.

25. An apparatus according to claim 24, wherein said electroconductive member is in the form of a coil spring.

26. An apparatus according to claim 23 or 24, further comprising regulating means for regulating a position of a contact portion of said electroconductive member relative to said peripheral surface of said rotation shaft.

27. An apparatus according to claim 26, wherein said regulating means is provided in said bearing member.

28. An apparatus according to claim 27, wherein said regulating means is in the form of a hole formed in said bearing member to permit penetration of said electroconductive member.

29. An apparatus according to claim 26, wherein said regulating means is provided in said peripheral surface of said rotation shaft.

30. An apparatus according to claim 29, wherein said regulating means is an annular engagement groove formed in said peripheral surface of said rotation shaft to engage with said electroconductive member. electroconductive member.

31. An apparatus according to claim 23, wherein said rotatable charging member is in the form of a roller.

32. A process cartridge detachably mountable to an image forming apparatus, said process cartridge comprising:

a member to be charged, which is capable of bearing an image;

a rotatable charging member, contactable to said member to be charged, for charging said member to be charged, said rotatable charging member being provided with a rotation shaft;

an electroconductive bearing member for receiving said rotation shaft, said rotation shaft being electrically connected with a voltage source for supplying a voltage to said rotatable charging member through said bearing member; and an electroconductive member, disposed in contact with a peripheral surface of said rotation shaft, to provide an electrical connection between the voltage source and said rotation shaft.

33. A process cartridge according to claim 32, wherein said electroconductive member has elasticity.

34. A process cartridge according to claim 33, wherein said electroconductive member is in the form of a coil spring.

35. A process cartridge according to claim 32 or 33, further comprising regulating means for regulating a position of a contact portion of said electroconductive member relative to said peripheral surface of said rotation shaft.

36. A process cartridge according to claim 35, wherein said regulating means is provided in said bearing member.

37. A process cartridge according to claim 36, wherein said regulating means is in the form of a hole formed in said bearing member to permit penetration of said electroconductive member.

38. A process cartridge according to claim 35, wherein said regulating means is provided in said peripheral surface of said rotation shaft.

39. A process cartridge according to claim 38, wherein said regulating means is an annular engagement groove formed in said peripheral surface of said rotation shaft to engage with said electroconductive member.

40. A process cartridge according to claim 32, wherein said rotatable charging member is in the form of a roller.

* * * * *

UNITED STATES PATENT AND TRADEMARK OFFICE

CERTIFICATE OF CORRECTION

PATENT NO. : 5,768,660

DATED : June 16, 1998

INVENTOR(S) : SATOSHI KURIHARA ET AL.

It is certified that error appears in the above-identified patent and that said Letters Patent is hereby corrected as shown below:

COLUMN 1

Line 21, "applied" should read --applied by--.

Line 64, "$10^3$-$10^4\psi$cm." should read --$10^3$-$10^4\Omega$m.

COLUMN 3

Line 37, "by charging roller (the charging)" should read --by the charging roller (charging--.

COLUMN 5

Line 50, "Since the" should read --The--.

COLUMN 9

Line 63, "hereinbefore," should read --hereinbefore.--.

COLUMN 10

Line 33, "tivity" should read --tive--.

COLUMN 12

Line 2, "the peripheral" should read --and the peripheral--.

UNITED STATES PATENT AND TRADEMARK OFFICE

CERTIFICATE OF CORRECTION

PATENT NO. : 5,768,660

DATED : June 16, 1998

INVENTOR(S) : SATOSHI KURIHARA ET AL.

It is certified that error appears in the above-identified patent and that said Letters Patent is hereby corrected as shown below:

COLUMN 13

Line 8, "groove 312" should read --grove 31a--.

COLUMN 15

Line 25, "electroconductive" (2nd occurrence) should be deleted.
Line 26 should be deleted.

Signed and Sealed this

Thirtieth Day of March, 1999

*Attest:*

Q. TODD DICKINSON

*Attesting Officer*

*Acting Commissioner of Patents and Trademarks*